United States Patent [19]

Konersmann

[11] 3,930,443

[45] Jan. 6, 1976

[54] METHOD FOR APPLICATION OF DATA TO A WORKPIECE AND APPARATUS FOR THE PERFORMANCE OF SUCH METHOD

[75] Inventor: Erhard Konersmann, Glattbrugg, Switzerland

[73] Assignee: Werkzeugmaschinenfabrik Oerlikon-Buhrle AG, Zurich, Switzerland

[22] Filed: Oct. 26, 1973

[21] Appl. No.: 410,048

[30] Foreign Application Priority Data

Nov. 3, 1972 Switzerland ..... 16021/72

[52] U.S. Cl. ..... 101/18

[51] Int. Cl.² ..... C23F 1/00; B44B 5/00; B41J 3/00

[58] Field of Search ..... 340/172.5; 101/35, 3 R, 101/18, 108, 320, 321, 363, 364, 350, 354, 3; 177/2, 10, 12, 13; 156/2, 10; 29/DIG. 16

[56] References Cited

UNITED STATES PATENTS 2,904,934 9/1959 Schicht ..... 51/26

2,947,120 8/1960 Bauer et al. ..... 51/26

*Primary Examiner*—Joseph M. Thesz, Jr.
*Assistant Examiner*—Paul R. Woods
*Attorney, Agent, or Firm*—Werner W. Kleeman

[57] ABSTRACT

A method for the application of data to a workpiece wherein the determination of the data occurs at a testing machine, and the data is transmitted to a marking device and applied by such marking device to the workpiece. According to the invention for the application of the data to the workpiece the workpiece is removed from the testing location of the testing machine and mounted at the marking device and the determined data remains stored after removal of the workpiece from the testing machine. The apparatus for the performance of the aforesaid method aspects is manifested by the features that the marking device is arranged externally of the testing location of the testing machine and a storage stores the data which has been determined at the testing machine.

2 Claims, 6 Drawing Figures

METHOD FOR APPLICATION OF DATA TO A WORKPIECE AND APPARATUS FOR THE PERFORMANCE OF SUCH METHOD

BACKGROUND OF THE INVENTION

The present invention relates to a new and improved method of applying data to a workpiece, especially to a bevel gear, wherein determination of the data occurs at a testing machine, especially a contact reflection testing machine, and the data is further transmitted to a marking or designation device and by means of such marking or designation device is applied to the workpiece. Furthermore, the invention is concerned with a new and improved construction of apparatus for the performance of the aforesaid method.

It is known for the application of data or other significant information to workpieces to imprint such workpieces with the data at the testing machine where such data has been ascertained, ink being used as the printing agent. A drawback of this technique is that the marking unit or device must be mounted at the testing machine, rendering more difficult actuation and supervising of the testing machine. A further drawback resides in the fact that the function of the marking unit is impaired. Additionally, when ink is used as the printing agent such does not furnish any really resistant labeling or marking, and a durable printing agent, such as for instance an etching agent a cannot be employed because of the danger of corrosion when the marking unit is mounted at the testing machine, e.g. the contact reflection testing machine. Finally, the testing machine is occupied for a much longer period of time by a workpiece, for instance the pair of bevel gears, when the marking operation occurs at the testing location.

SUMMARY OF THE INVENTION

Hence, it is a primary object of the present invention to provide an improved method of, and apparatus for the application of data to a workpiece which is not associated with the aforementioned drawbacks and limitations of the prior art proposals discussed above.

Another and more specific object of the present invention relates to an improved method of, and apparatus for, marking or labeling workpieces, especially bevel gears, by means of which data can be durably applied to the workpieces, and wherein the accessibility of the testing machine is not hindered and there does not occur any danger of contamination of the workpiece marking or designation unit.

Now in order to implement these and still further objects of the invention, which will become more readily apparent as the description proceeds, the method aspects of this development are manifested by the features that for the application of the data to the workpiece the workpiece is removed from the testing location of the testing machine and is introduced into a marking or designation device, the determined data being stored after the removal of the workpiece from the testing location.

Apart from the aforementioned method aspects the invention is also concerned with a new and improved construction of apparatus for the performance thereof which comprises a marking device which is arranged externally of the testing location of the testing machine and a storage which stores the data which has been ascertained at the testing machine.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
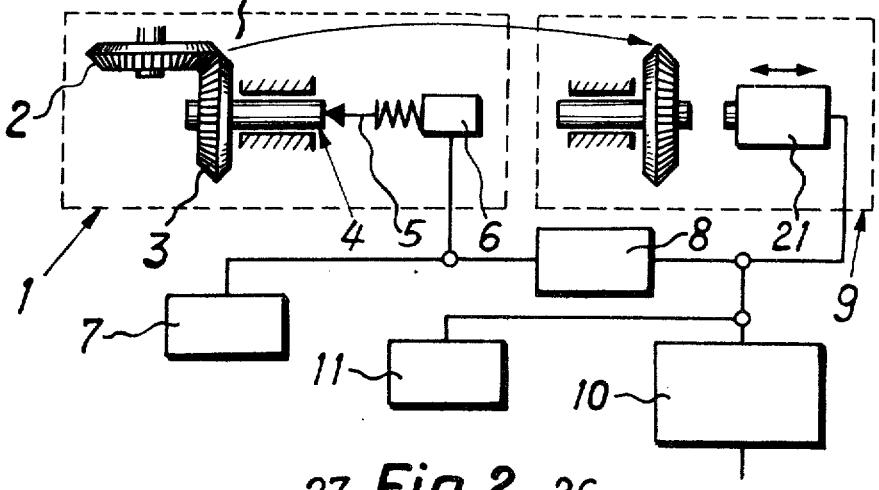
FIG. 1 schematically illustrates an exemplary embodiment of apparatus for the performance of the method aspects of this development.

Describing now the drawings, according to the showing of FIG. 1 there are located at the testing location, generally indicated by reference character 1*a*, of a conventional testing machine 1, such as known from U.S. Pat. Nos. 2.947,120 and 2,904,934, which therefore need not be further described, two bevel gears 2, 3 of a pair of bevel gears. At the testing machine 1 there is determined, for instance according to acoustical or optical criteria, at which mutual position the bevel gears 2 and 3 are located in optimum meshing engagement. Owing to small irregularities in the course of production of the gears their meshing action generally is not always then optimum when both of the bevel gears assume their theoretically determinable proper mutual position, rather then when, for instance, the gear 3 is shifted along its shaft or axle 4 through a small distance out of its theoretically correct position. The magnitude of such displacement path is determined at the testing machine 1 with the aid of a scanner or feeler 5. The value determined by the scanner 5 is transformed at a measurement value transducer 6 into an electrical voltage signal. The measured deviation also can be rendered visible by means of a digital measurement value indicator 7. At the same time the data is fed into a storage or store 8. Now the bevel gears 2 and 3 can be removed out of the testing machine 1 and the gear 3 can be introduced into the marking or labeling device 9 without the thus ascertained data becoming lost. The testing location 1a of the testing machine 1 is therefore now free to receive the next pair of bevel gears. By means of the stored data or information there is now adjusted at the marking device 9 the printing information and the data is then applied to the bevel gear 3, the data preferably being applied to the end face of the workpiece i.e. gear 3. The printing data can be simultaneously rendered digitally visible at an indicator panel 10 or can be imprinted upon a paper strip or tape by means of a recording or writing device 11.

The marking device 9 possesses a housing 21 with switching wheels or gears 22 and printing wheels 25 at which there are secured printing type 26. Furthermore, the device 9 possesses an etching agent container 31 (FIG. 3) and an apparatus for dosing the etching agent as well as for imbuing the printing type with such etching agent, all as now to be considered more fully.

Figure 2:
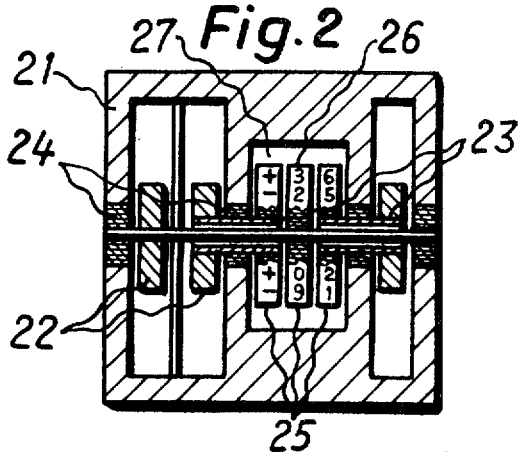
FIG. 2 is a sectional view through a housing with switching wheels and printing wheels.

FIG. 2 illustrates details of the housing 21 in which there are mounted three switching or indexing wheels 22 which are independently electrically adjustable. The wheels are located at concentric hollow shafts 23 which are mounted for instance in TEFLON bearings 24. Hence, data or information consisting for instance of a sign character and two numbers can be printed. The switching wheels 22 cannot be simultaneously employed as printing wheels 25 since for constructional reasons they must possess a certain mutual spacing. If the printing type 26 were located at the switching wheels 22 then there would be produced at the bevel gear 3 printed data having printed characters or information symbols which are widely spread apart, something which in any case would be very difficult to read and in the case of small bevel gears could not even be applied because of insufficient space. Furthermore, it is not desirable to arrange the electrical switching device in a space in which there also can arrive etching agent residues at the printing type 26. The switching or indexing wheels 22 therefore are located in housings or casings protected against the vapors of the etching agent and which housings are sealed with respect to the printing compartment 27. Each printing wheel 25 is coupled with an associated switching or indexing wheel 22 by means of which it can be selectively adjusted. The printing wheels 25 carry as the printing type either the signs plus (+) and minus (−) or the numbers from 0 to 9. The printing types 26 consist of an elastic material resistant to the etching agent.

Figure 3:
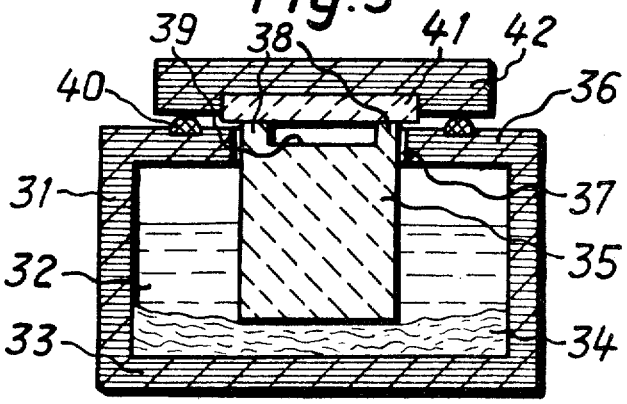
FIG. 3 is a sectional view through a printing agent container and a dosing mechanism.

FIG. 3 illustrates the etching agent container 31 within which there is located the etching agent 32, for instance a liquid formed on the basis of a mineral acid. At the floor or bottom 33 of such etching agent container 31 there is located a layer of resilient etching agent-resistant rock wool 34. A porous absorbent or suction block 35 consisting of ceramic bound carborundum and serving as dosing means for the etching agent, bears against the rock wool 34 and partially extends out of the etching agent 32 and through an opening 37 of a cover 36 of the etching agent container 31 into the surroundings. The absorbent block 35 possesses for instance a rectangular cross-sectional configuration, and two lateral webs 38 thereof are higher than the central portion 39 of such block. A sealing O-ring 40 formed of etching agent-resistant elastic material is arranged about the opening 37 of the etching agent container 31, as shown.

FIG. 3 additionally depicts an imbuing or wetting block 41 defining a porous disk which is mounted in a wetting block carrier 42. In the depicted position the wetting block carrier 42 bears against the O-ring 40, so that the etching agent container 31 is tightly sealed.

The wetting block 41 and the wetting block carrier 42 serve for imbuing or wetting the printing type with etching agent. The wetting block 41 only bears upon the webs 38 of the absorbent block 35 in order to prevent too much etching agent reaching the wetting or imbuing block 41. Wettting block 41 and wetting block carrier 42 are of substantially disk-shaped configuration. They are pivotably mounted and in a rest position assume the position depicted in FIG. 3, whereas in the work or effectual position the wetting block 41 bears with its circular surface against the printing type 26. The wetting block 41 contacts the printing type 26 only by means of its central portion which has not been in contact with the absorbent block 35. In this way there is prevented that too much etching agent 32 will reach the printing type 26.

Figure 4:
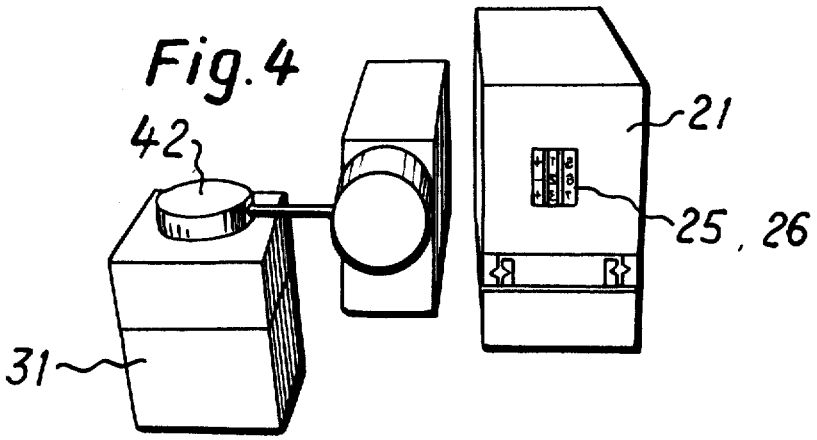
FIGS. 4, 5 and 6 respectively show different phases of the wetting or imbuing of the printing type with the printing agent.
Figure 5:
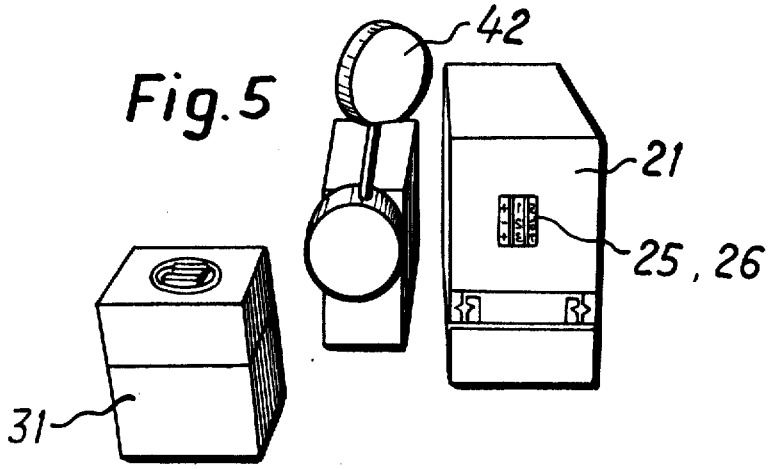
Figure 6:
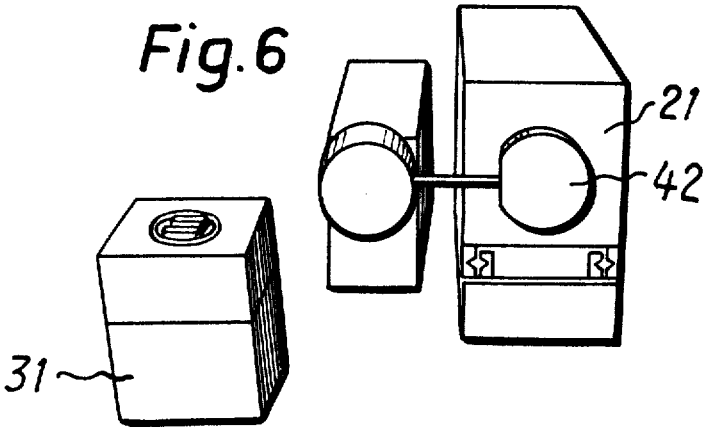

The function of the marking device or unit will be readily apparent from the construction and will be easily understood with respect to FIGS. 4 to 6:

The switching or indexing wheels 22 are adjusted in accordance with the data or information determined at the testing machine 1. Consequently, the printing wheels 25 are also brought into the proper position. During this phase the wetting block 41, according to the showing of FIG. 4, is located at the absorbent block 35 of the etching agent container 31 and sucks-up etching agent 32. Thereafter the wetting block 41, according to the showing of FIG. 5, is pivoted and reaches the type imbuing or wetting position depicted in FIG. 6. During the pivoting operation and the wetting or imbuing operation the etching agent container 31 is open. After the wetting block 41 has again been pivoted back into its original position there occurs the printing operation. To this end the printing type 26 are pneumatically moved with the housing 21 along a non-illustrated carriage against the bevel gear 3 which is to be marked or labeled. The carriage can travel within its stroke in each position as a stop against the bevel gear end face. The marking or labeling is thus likewise applied to the end face of the bevel gear 3.

Another possibility for marking the bevel gear is the use of an electro-recording device of known construction which operates on the principle of arcing. In order to be able to use an electro-recording device for the automatic marking it is not sufficient to only arrange one recording or writing pen. It is however possible to assemble together a certain number of recording pens, — for instance 15 pens in five lines, each of which have three pens — into a needle matrix. With appropriate electrically controlled circuitry for the required recording pens the necessary printed characters then can be composed of points or dots.

A further possibility for marking or labeling the bevel gears is the use of anodic or oxide coating techniques. In order to carry out an automatic marking with such eloxal process the desired lines and numbers are arranged in succession at a band and there stamped or punched-out. This band (stencil) for marking must then be brought into the momentarily desired position. The marking then occurs by infeeding an electrolyte (etching agent) while applying voltage.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. Apparatus for etching data on the metallic surfaces of a workpiece comprising, a housing, printing wheels having printing type secured thereon and mounted within said housing, an etching agent container disposed adjacent to said housing for containing an etching liquid, an absorbent block extending partially into the etching liquid through an opening in said container, said absorbent block having a surface extending out of the etching liquid, a wetting block mounted between said housing and said container for movement into first and second positions, said wetting block having a contact surface, a first portion of which engages the surface of said absorbent block extending out of the etching liquid when said wetting block is moved into said first position and a second portion of which engages said printing type when said wetting block is moved into said second position, the size of said absorbent block surface which engages the first portion of the contact surface of said wetting block being chosen so as to prevent excessive wetting of the wetting block with said etching liquid.

2. Apparatus according to claim 1 wherein said printing wheels are mounted in a printing wheel compartment within said housing on shafts disposed in said housing, and including an electrically adjustable switching wheel associated with each printing wheel and mounted on the shaft of its respective printing wheel, said switching wheels being sealingly separated from said printing wheel compartment whereby said switching wheels are protected from the vapors of the etching liquid in said printing wheel compartment.

* * * * *